United States Patent [19]

Allebach

[11] 4,351,180

[45] Sep. 28, 1982

[54] WORKPIECE TURNING TRANSFER

[75] Inventor: Gene E. Allebach, Tiffin, Ohio

[73] Assignee: The National Machinery Company, Tiffin, Ohio

[21] Appl. No.: 164,774

[22] Filed: Jun. 30, 1980

[51] Int. Cl.[3] ..... B21D 43/10

[52] U.S. Cl. ..... 72/405; 10/12 T

[58] Field of Search ..... 72/405, 421, 422, 404; 10/11 T, 11 A, 12 T, 72 T, 76 T

[56] References Cited

U.S. PATENT DOCUMENTS

| | | | |
|---|---|---|---|
| 2,074,104 | 3/1937 | Criley | 10/12 T |
| 3,105,399 | 10/1963 | Strugala | 72/405 |
| 3,165,766 | 1/1965 | Wisebaker | 72/405 |
| 3,262,303 | 7/1966 | McClellan | 72/368 |
| 3,412,595 | 11/1968 | Kull | 10/12 T |
| 3,466,917 | 9/1969 | Eakin | 72/405 |
| 3,488,784 | 1/1970 | Hatebur | 10/12 T |
| 3,965,718 | 6/1976 | Kline | 72/405 |
| 4,084,278 | 4/1978 | Allebach | 10/76 T |
| 4,186,589 | 2/1980 | Criblez | 72/421 |

FOREIGN PATENT DOCUMENTS

| | | | |
|---|---|---|---|
| 143314 | 12/1953 | Sweden | 72/405 |

*Primary Examiner*—Gene Crosby

*Attorney, Agent, or Firm*—Pearne, Gordon, Sessions, McCoy & Granger

[57] ABSTRACT

A forging machine transfer is disclosed which is operable in response to transfer movement to turn a gripped workpiece about an axis perpendicular to a plane containing the axis of an elongated workpiece. A single pivoted gripper grips the workpiece against a flat, non-rotating platform and causes the workpiece to slide along such platform as the workpiece is transferred to a subsequent work station. The pivot axis is eccentrically located so that the workpiece is moved toward the die face during transfer to be properly positioned for subsequent working at the delivery position. A pivoted drive linkage provided to produce the rotation is located above the work station to reduce the likelihood of bearing damage resulting from scale or the like. The angle through which the workpiece is rotated can be selected within a range substantially greater than 90 degrees and substantially less than 90 degrees.

20 Claims, 8 Drawing Figures

WORKPIECE TURNING TRANSFER

BACKGROUND OF THE INVENTION

This invention relates generally to automatic progressive forging machines, and more particularly to a novel and improved transfer for such machines which is operable to partially turn a blank or workpiece as it is transferred from one work station to the next.

PRIOR ART

Progressive formers are typically provided with automatic transfers which grip a workpiece as it is ejected from the die at one work station and transport the workpiece to a position in front of the die at a subsequent work station. Very often, the transfer is accomplished without any turning of the blank, as described and illustrated in U.S. Pat. Nos. 3,262,303 and 3,965,718. In other instances, usually in nut formers or the like, the transfer rotates the workpiece through 180 degrees during the transfer between at least some of the work stations. An example of such transfer is illustrated in U.S. Pat. No. 3,165,766. In still another type of transfer, illustrated in U.S. Pat. No. 3,466,917, the workpiece is supported at one end and is allowed to be turned by gravity through 90 degrees during its transfer from one work station to the next. This last transfer, however, does not grip the blank during turning, and cannot be used for many types of blanks. All of the patents mentioned above are assigned to the assignee of the present invention.

In addition, it is known to provide transfers for forging machines which rotate cylindrical workpieces about their axes in response to movement of the transfer. Such transfers are used in machines in which the workpiece is laterally gripped in clamping dies and the rotation is used to eliminate longitudinal ridges along the length of the workpieces produced by such gripping dies. Such transfers, in some instances, use drag links connected to an arm to produce such rotation.

SUMMARY OF THE INVENTION

In accordance with the present invention, a transfer is provided for progressive formers which is operable to grip a workpiece at one work station and to partially turn the gripped blank through a desired angle, 90 degrees in the illustrated embodiment, as it is transferred from one work station to the next. The illustrated embodiment of this invention is applied to the basic transfer illustrated in U.S. Pat. No. 3,965,718 and such patent is incorporated by reference to illustrate the environment and basic drive for the transfer. Such transfer is particularly suited for hot forging machines, since the drive and principal bearing system are located remote from the work area where they are protected from heat and scale.

The turning transfer utilizes a pivoted gripper which grips the workpiece as it is ejected from one work station, and which is pivoted by a drag linkage in response to transfer movement so that the workpiece is turned to the desired orientation by the time it moves to the subsequent work station. Further, the gripper is offset from the pivot axis so that the workpiece is properly centered in front of the die at the subsequent work station and has been moved inwardly toward the die. With such system, the transfer can be used with an elongated workpiece, which requires substantial spacing between the center of the workpiece and the die of the first work station, and a lesser spacing between the center of the workpiece and the die at the subsequent work station.

Alternatively, the offset can be structured to locate the workpiece in an off-center position if, for example, the subsequent operation is performed at a location spaced from the center of the blank. One example of such off-center working is involved in the manufacture of eye-bolts.

In the illustrated embodiment, the gripping of the workpiece is accomplished by pressing the workpiece against a nonrotating support plate or platform along which the workpiece slides as it is turned during its transfer. With this structure, only one portion of the gripping transfer system need be rotated for the turning movement of the blank, and the other portion of the gripper is nonrotating. This provides considerable simplification of the structure of the system, reduces cost, and reduces the likelihood of maintainance problems because the lower gripper, which is exposed to the most scale, does not have moving parts.

Since the turning movement is provided in response to the main transfer movement, a separate power drive is not required. Further, the geometry of the turning linkage can be selected to provide greater or lesser angles of turning. Still further, the turning drive linkage utilizes only pivot type bearings which are easy to properly lubricate and which are not easily damaged by scale and the like when the invention is applied to a hot former.

DETAILED DESCRIPTION OF THE DRAWINGS

Figure 1:
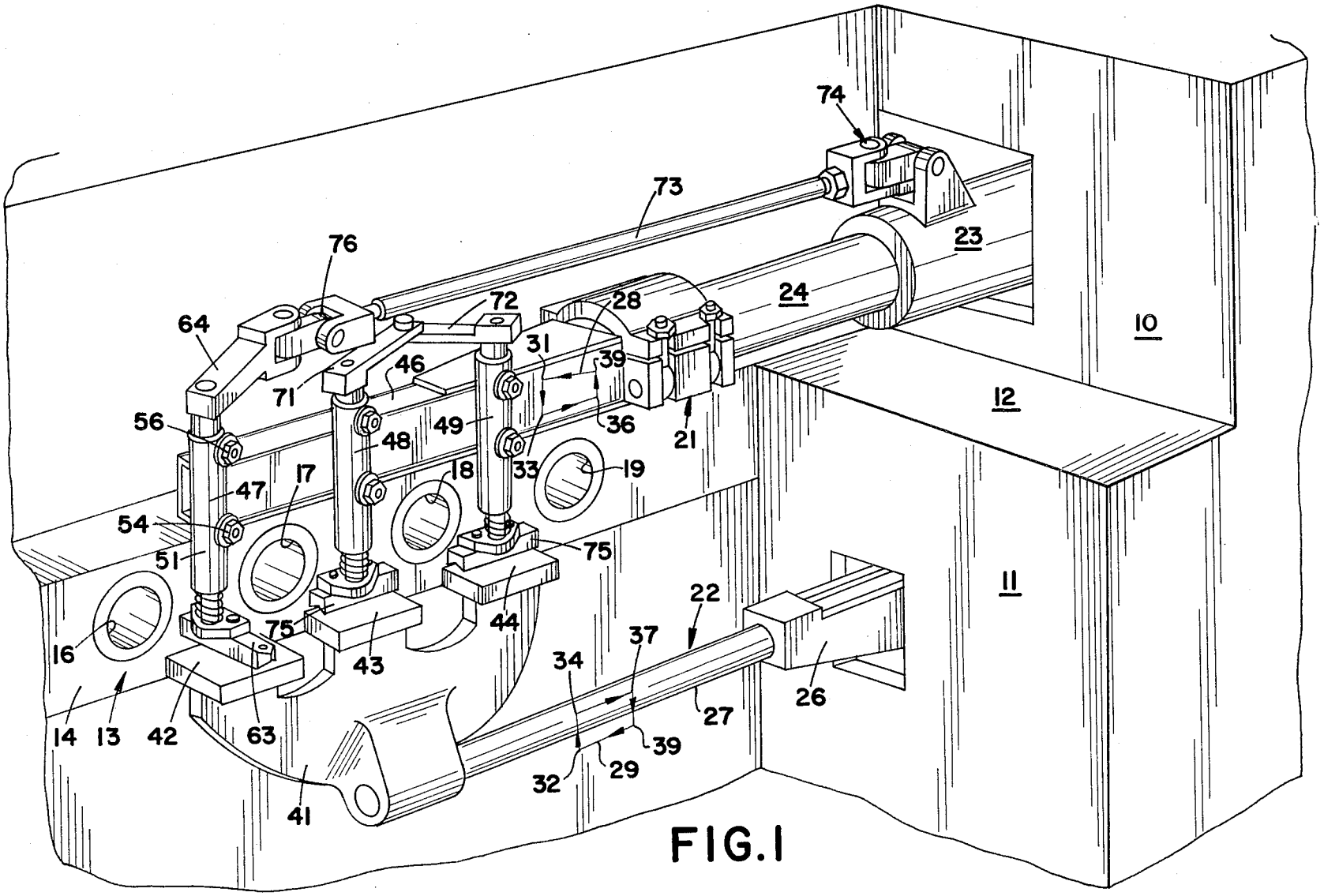
FIG. 1 is a perspective view of a transfer incorporating the present invention, in which workpiece turning is provided during the transfer between a first work station and the second work station, and wherein the transfer between the subsequent work stations does not involve turning of the workpiece.

FIG. 1 schematically illustrates the principal structure of the transfer system and the adjacent portions of the machine. In this figure, the transfer drive system has not been illustrated, but is fully disclosed in FIG. 5 of U.S. Pat. No. 3,965,718 to Kline, which is incorporated herein by reference. The transfer of such patent is particularly suited for use in hot forging machines, since the principal drive and support system for the transfer is located behind a wall 122 of such patent, where it is protected from scale, heat, etc.

A similar structure is illustrated in FIG. 1 hereof, wherein walls 10, 11, and 12 isolate the transfer support and drive system from the work area to the left of the walls in FIG. 1. The work area is designated generally as 13. Located in such work area 13 is a die breast 14 providing four work stations 16, 17, 18, and 19. Normally, a die is mounted in the bore at each work station, but for purposes of simplification, the dies are not illustrated in detail in FIG. 1.

In the operation of the machine, a workpiece is first positioned at the first work station 16, where an initial operation can be performed on the workpiece. After the operation on the workpiece, the workpiece is ejected from the die at the first work station into the transfer assembly, as discussed in greater detail below, and is transferred to the second work station 17 where a subsequent operation is performed on the workpiece. Thereafter, the workpiece is progressively positioned at the remaining work stations 18 and 19 and is progressively worked to the final required shape. A reciprocating slide (not illustrated) mounted on the frame carries tools which cooperate with the dies in the work stations to progressively form the workpiece to the desired shape.

In the illustrated embodiment, a transfer system is provided having an upper transfer assembly 21, and a lower transfer assembly 22 which extend through the walls 10 and 11 into the work area 13 of the machine. The upper transfer assembly 21 includes a support tube 23 corresponding to the member 101 of U.S. Pat. No. 3,965,718, which is pivoted for limited pivotal movement in a vertical plane about a horizontally extending pivot axis 103 of such patent. Supported in the support tube 23 for axial movement relative thereto is a reciprocating rod 24 which moves in and out of the tube 23 through a distance equal to the centerline spacing between the respective work stations 16 through 19. Here again, the drive for producing such reciprocation is described in detail in the Kline U.S. Pat. No. 3,965,718, supra.

The lower transfer assembly 22, like the upper assembly 23, includes a support tube or member 26, which is also pivoted for limited pivotal movement in a vertical plane about an axis parallel to the pivot axis of the support tube 23. Here again, a reciprocating rod 27 is mounted on the support member 26 for axial movement with respect thereto.

The drives for the two assemblies operate to produce movement of the upper reciprocating rod 24, as illustrated in the movement diagram 28, and movement of the lower rod 27, as illustrated in the movement diagram 29.

The transfer movement of the two reciprocating rods 24 and 27 is timed with the operation of the machine and contains the following synchronized movements. The two rods 24 and 27 both extend after the rods are moved apart until the points 31 and 32 in the respective movement diagrams are reached. As a workpiece is ejected from the dies, the two rods move toward each other to the movement diagram positions 33 and 34 to grip a workpiece. In such position, the two rods are parallel to each other and, as they retract to the diagram positions 36 and 37, there is no change in the spacing between the rods but they move through a distance equal to the spacing between the adjacent work stations to transport a gripped workpiece to a subsequent work station. After the transfer movement is completed, the rods are moved apart to release the workpiece until the movement diagram positions 38 and 39 are reached. In such position, the two rods 24 and 27 are not parallel, and as they extend, the grippers move slightly further apart. The transfer operates with repeated cycles with the movement just described. Thus far described, the transfer is essentially the same as the transfer illustrated in the Kline U.S. Pat. No. 3,965,178, supra.

Although this invention is illustrated as applied to the hot former transfer, it is equally applicable to other forms of transfer. Therefore, except to the extent defined in the claims, the basic hot former transfer is not a critical part of this invention.

In accordance with the present invention, the transfer system is provided with grippers which are selectively operable to turn a workpiece through a desired angle as it is transferred between adjacent work stations. In the illustrated embodiment, the transfer is arranged to turn a workpiece through 90 degrees as it is transferred from the work station 16 to the work station 17. The illustrated transfer, however, does not provide for turning during the transfer of workpieces between the work stations 17 and 18, and between the work stations 18 and 19. It should be understood, however, that it is within the broader scope of this invention to provide turning of the workpiece at any or all of the transfer operations. Further, although the transfer is illustrated as turning a workpiece through 90 degrees, it is operable with equal facility to turn the workpiece through other angles substantially greater or less than 90°.

This illustrated transfer permits an elongated workpiece to be worked by endwise forces during the first working operation and then turned so that lateral forces are applied during the subsequent three working operations. Such system can be used, for example, to produce connecting rod bearing caps from wire stock.

Mounted at the end of the reciprocating rod 27 is the lower gripper assembly 41. Such gripper assembly is provided with three gripper platforms 42, 43, and 44.

Mounted on the end of the reciprocating rod 24 is a gripper frame 46 on which are mounted three upper gripper assemblies 47, 48, and 49. The first upper gripper assembly 47 is positioned immediately above the first gripper platform 42 and cooperates therewith to grip and support a workpiece as such workpiece is transferred from the first work station 16 to the second work station 17.

In the illustrated embodiment, the general structure of each of the upper gripper assemblies 47 through 49 is substantially the same and, consequently, all three gripper assemblies can be selectively arranged to provide workpiece turning. However, in the illustrated embodiment, only the first gripper assembly 47 is arranged to turn a workpiece and the two gripper assemblies 48 and 49 are locked against pivotal movement so that the workpiece is not turned as it is transferred between the work stations 17 through 19.

Figure 3:
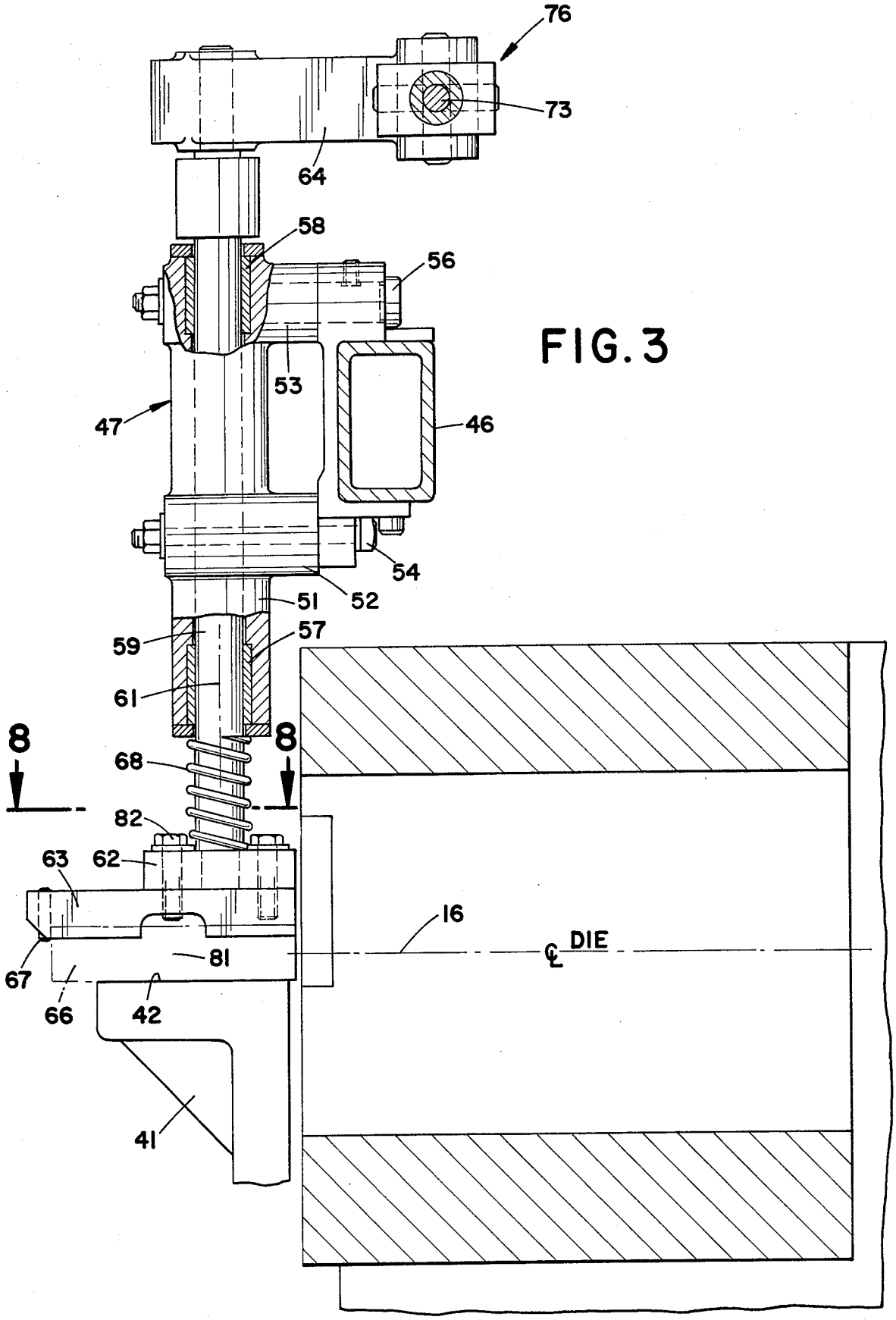
FIG. 3 is a side elevation of the transfer.

Referring now to FIG. 3, the upper gripper assembly 47 is provided with a tubular housing 51 having lug extensions 52 and 53, permitting it to be removably mounted on the frame 46 by means of bolts 54 and 56. Mounted in the tubular housing 51 are spaced sleeve bearings 57 and 58 which journal a central shaft 59 for pivotal movement about its central axis 61. Mounted at the lower end of the shaft 59 is an eccentric mounting pad 62 on which the upper gripper element 63 is mounted. Mounted on the upper end of the shaft 59 is an arm 64 which is connected to a linkage to cause the rotation of the shaft 59, and in turn the gripper element 63 itself.

The gripper element 63, in the illustrated embodiment, is shaped to grip and handle a cylindrical workpiece 66 indicated in phantom in FIG. 3. This gripper element includes a V-shaped lower surface along which the workpiece 66 extends and a stop pin 67 which engages the end of the workpiece during the turning operation to prevent relative axial movement between the workpiece 66 and the gripper element 63 in a manner described below.

In order to accommodate variations in tolerances and the like, the central shaft or pivot rod 59 is spring-biased by a spring 68 toward the associated gripper platform 42. The various elements are adjusted so that when the two reciprocating rods 24 and 27 are moved toward each other, carrying the two gripper assemblies toward each other, the workpiece 66 will be engaged slightly before completion of the closing movement, causing some compression of the spring 68. This ensures that full gripping of all three workpieces will be accomplished without overloading any of the gripper assemblies.

The structure of the two gripper assemblies 48 and 49 is essentially identical to the structure just described. However, since turning is not required for these gripper assemblies, a pair of arms 71 and 72 are connected to each of the grippers and to each other to prevent such rotation. Further, the subsequent gripper elements 75 are appropriately shaped to grip the worked part being transferred.

Figure 2:
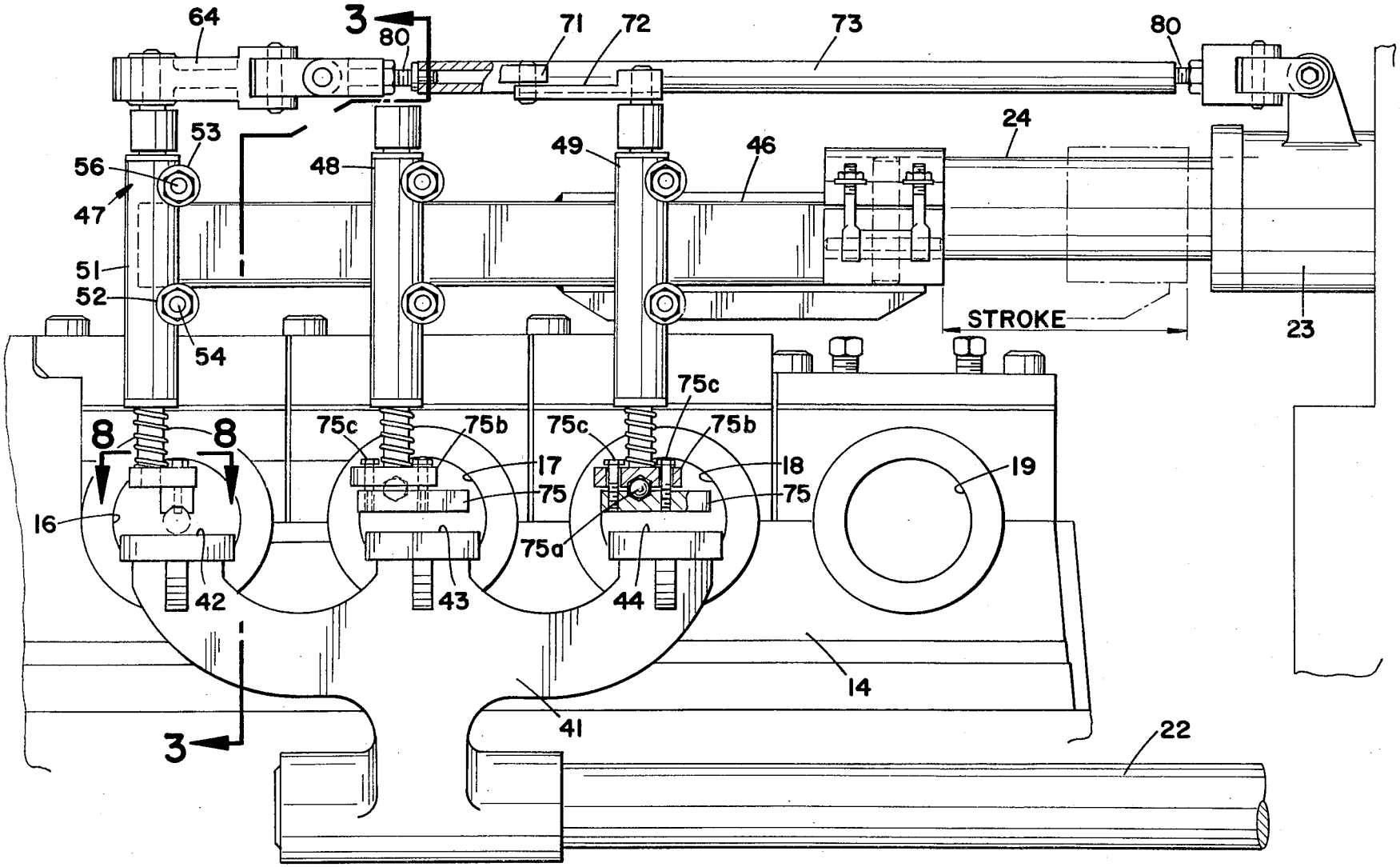
FIG. 2 is a front elevation of the transfer illustrated in FIG. 1.

Referring to FIG. 2, the grippers 75 are provided with a floating mounting so that they can tip to a limited degree to properly grip workpieces which have some shape variations. This mounting includes a ball **75*a* positioned in pockets in the gripper 75 and its support 75*b* and loose bolts 75*c* which extend loosely through the support 75*b* and are threaded into the grippers 75**.

Figure 4:
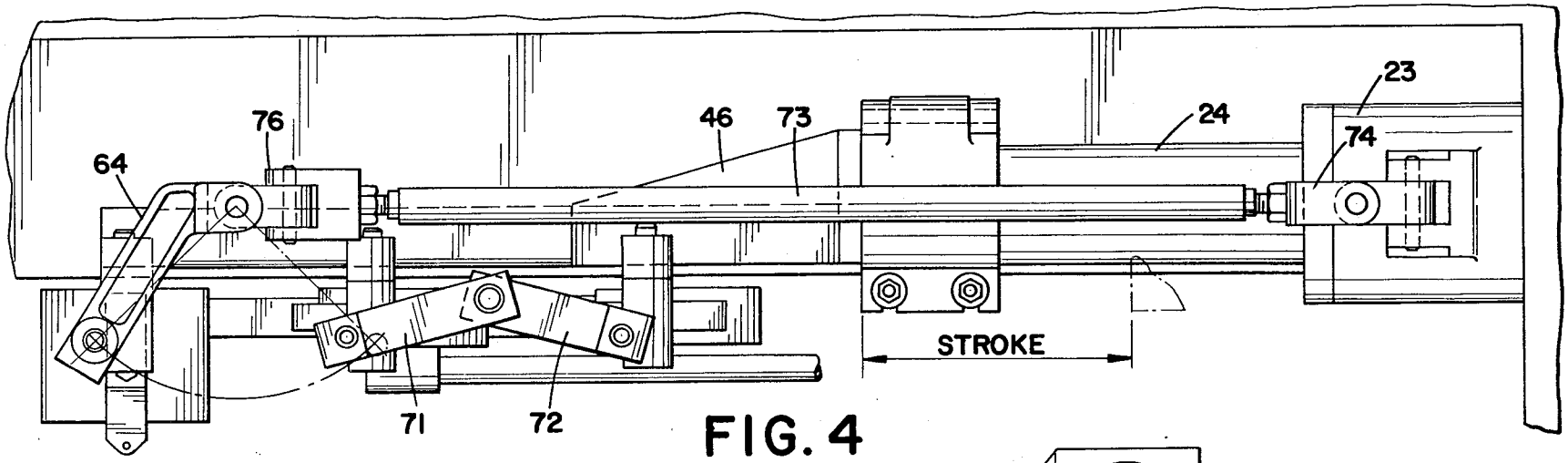
FIG. 4 is a plan view of the transfer illustrating the linkage utilized to produce the turning movement during the transfer operation.
Figure 8:
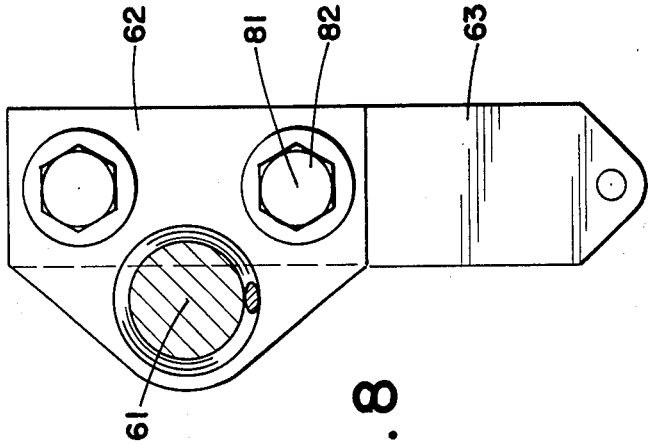
FIG. 8 is an enlarged, fragmentary plan view taken along line 8—8 of FIG. 2.

The drive linkage for rotating the first gripper through 90 degrees is best illustrated in FIGS. 1, 2, and 4. This linkage includes a drag link 73 connected at one end through a universal joint 74 to the support tube 23. The other end of the drag link 73 is connected through a second universal joint 76 to the arm 64. Since the support tube 23 does not move back and forth with the gripper as the gripper reciprocates between its extended and retracted positions, the drag link 73 does not move back and forth when the transfer moves between its extended and retracted positions. The connection between the drag link 73 and the arm 64, therefore, produces relative rotation during the reciprocating movement of the transfer to cause the rotational movement of the gripper element 63.

Figure 5:
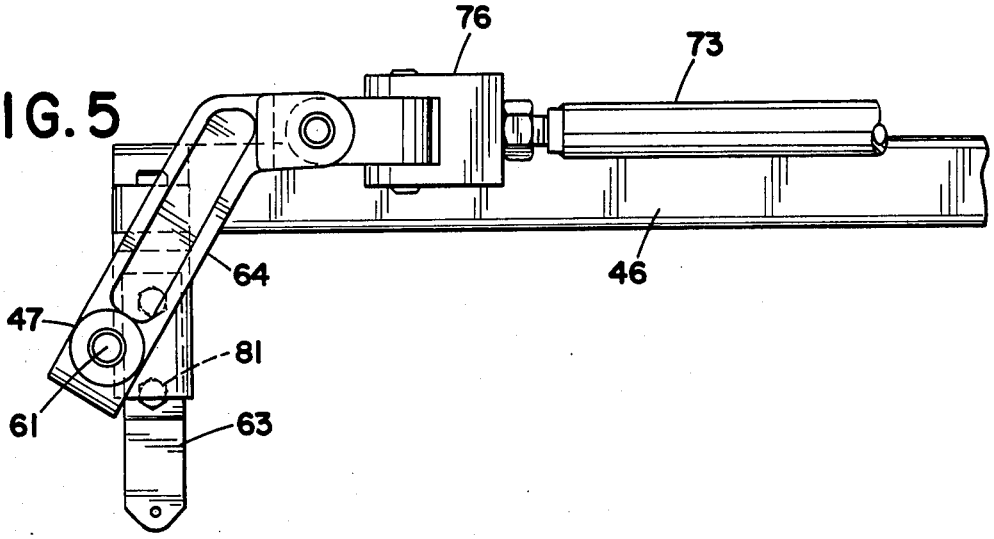
FIG. 5 is an enlarged, fragmentary plan view of the turning linkage illustrated in the pickup position, where the workpiece is gripped.
Figure 6:
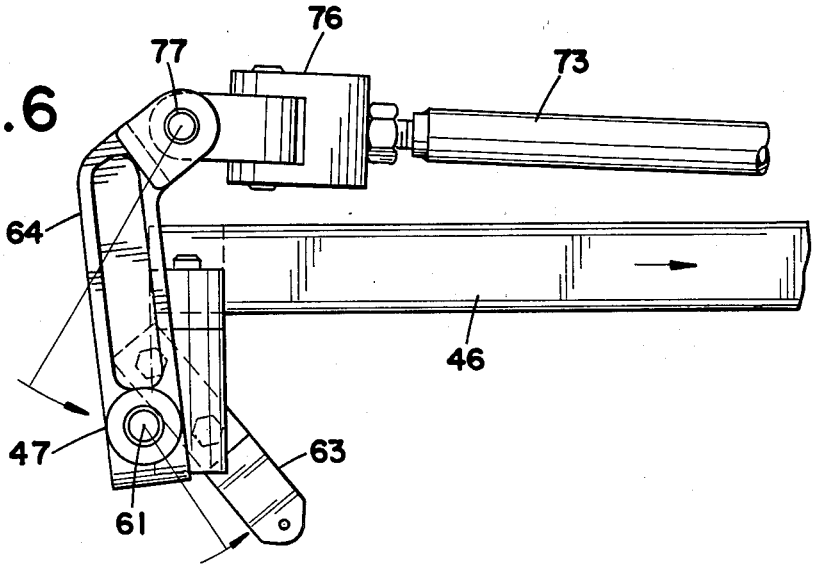
FIG. 6 is an enlarged, fragmentary, plan view similar to FIG. 5, but illustrating the linkage in the mid position of transfer in which the workpiece is partially turned.
Figure 7:
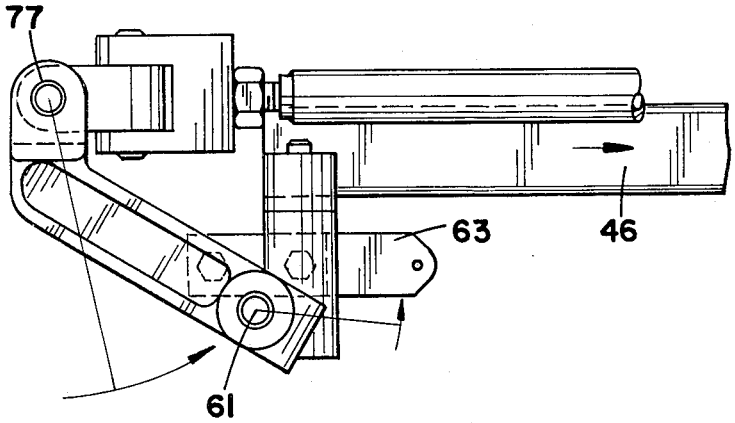
FIG. 7 is an enlarged, fragmentary view, similar to FIGS. 5 and 6, but illustrating a linkage in a delivery position in which the workpiece is turned through 90° and delivered to the second work station.

The geometry of this operation is best illustrated in FIGS. 5 through 7, which show the mechanism in progessive positions. In the position of FIG. 5, the transfer is fully extended with the frame 46 in its extended position. In such position, the gripper element 63 is in position to receive a workpiece from the first work station 16, and the drag link 73 maintains the gripper element substantially perpendicular to the face of the dies.

FIG. 6 illustrates the mechanism after the transfer operation has proceeded approximately half-way between the pickup position and the delivery position. In the position of FIG. 6, the frame 46 has moved to the right to about half its stroke, carrying with it the gripper 47. During such movement, however, the drag link 73 is fixed against any axial movement, so rotation of the arm 64 with respect to the first gripper assembly 47 occurs and the gripper element 63 has rotated in an anticlockwise direction through about 45 degrees.

During this movement, the arm 64 moves to a position in which it is roughly perpendicular to the direction of transfer. This requires that the adjacent end of the drag link 73 move laterally away from the frame 46 to some extent, as illustrated in FIG. 6.

As the transfer continues to move toward its delivery position, the linkage continues to cause turning of the gripper member 63 until the delivery position is reached, as illustrated in FIG. 7. In such position, the frame member 46 has moved through its full stroke and with the illustrated geometry, the gripper element has rotated through exactly 90 degrees. To accomplish this 90-degree movement, it is preferable to arrange the geometry so that the drag link 73 moves back to the same alignment position with respect to the frame 46 as it is in the pickup position. This is accomplished in a 90-degree rotation situation by arranging the linkage so that a line between the pivot 77 and the axis 61 is at an angle of 45 degrees with respect to the longitudinal line of movement in both extreme positions. In such geometry, the drag link is in the same position in the two extreme transfer positions.

With such geometry, the following formula may be used to establish the length of the arm 64 for a given turning angle and transfer stroke.

$$A = S/2 \text{ sine } (a/2)$$

In this formula, the terms have the following meaning:

A = the length of the arm 64 between the axis 61 and the axis of the pivot 77;

S = the stroke of the transfer;

a = the angle of turning required.

The drag link 73 is provided with length adjusting means 80 at each end so that the geometry of the system can be accurately adjusted in the installed transfer.

In some instances, it is desirable to arrange the transfer so that the workpiece is moved inward with respect to the die face as it is turned and transferred from the first work station 16 to the second work station 17. For example, if an elongated workpiece is being transferred (of the type illustrated in FIG. 3), it must be ejected a sufficient distance to clear the die at the work station 16 and, because of its elongated shape, its center at about 81 as illustrated in FIG. 3 is spaced from the face of the dies a substantial distance. However, after the blank is turned through 90 degrees, the center of the workpiece would be too far from the die face at the work station 17 if the transfer were not arranged to move the workpiece closer to the die face as it is transferred.

This movement toward the die face is accomplished by the offset mounting of the gripper member 63 with respect to the pivot axis 61 of the gripper. Again, in the illustrated embodiment in which the turning is through an angle of 90 degrees, a similar formula can be used to establish the angle and distance of offset. This further presupposes that a line between the point 81 on the axis of the blank which is to be centered with respect to the second die and the pivot axis 61 is parallel to transfer movement when the transfer has turned through one-half of its angle of turning.

$$E = D/2 \text{ sine } (a/2)$$

E = the distance between the pivot axis 61 and the blank center 81.

D = the distance the blank center 81 must move toward the die face.

a = the turning angle.

This formula also presupposes that during the movement of the transfer, the center 81 of the workpiece moves through a distance equal to the stroke of the transfer in the direction of transfer movement. Where the angle of transfer rotation is equal to 90 degrees, the line between the pivot axis 61 and the center of the workpiece 81 will be displaced from the plane of movement of the transfer by 45 degrees in both the blank receiving and blank delivery positions.

In some instances, however, it may be desired to position the workpiece at the second work station in an offset position so that offset working can be performed. One example of such an arrangement would be involved in the manufacture of eye-bolts where subsequent lateral working is performed on the end of the workpiece. In such arrangement, the offset of the blank gripping is suitably modified.

In the illustrated embodiment, the lower gripper does not rotate and the workpiece slides along the gripper platform 42 as it is rotated from the gripping position to the release position. This use of a gripper transfer for rotation in which only one element of the gripper rotates greatly simplifies the structure and the drive of the system. Further, it eliminates the need for bearings in the lower portion of the transfer where scale can present the greatest problem. Because the movement of the workpiece as it slides along the gripper platform 42 is eccentric from a pivot axis, a stop pin 67 is provided to engage the end of the blank and prevent relative axial movement between the workpiece 66 and the gripper member 63.

With the present invention, selective rotation of the workpieces may be accomplished. By proper selection of the length of the various linkage elements, the angle of rotation can be changed to meet the particular requirements of the part being manufactured. The linkage can be used to turn workpieces through angles substantially less than or substantially greater than 90 degrees; for example, angles approaching 180 degrees are possible. Further, with the illustrated invention, all of the transfer elements within the work area utilize pivot bearings which are easily protected against damage by scale or heat when the transfer is applied to hot forging. Still further, the linkage, because it produces rotation in response to transfer movement, does not require any separate drive for the rotary movement. Finally, the offset arrangement of the gripper is utilized when it is desired to move the blank toward the die face during the transfer movement.

Although the preferred embodiment of this invention has been shown and described, it should be understood that various modifications and rearrangements of the parts may be resorted to without departing from the scope of the invention as disclosed and claimed herein.

What is claimed is:

1. A forging machine transfer for transferring elongated workpieces between two work stations comprising a pair of grippers operable to close and grip a workpiece at one work station and to move in a transfer direction with a gripped workpiece to another work station, one of said grippers being pivoted to rotate said workpiece about an axis which is not parallel to the length of said gripped workpiece, and drive means connected to rotate said one gripper in response to movement in said transfer direction between said work stations, the other of said grippers being free of drive means and not permitting rotation thereof, said drive means providing a linkage including an arm on said one gripper and a drag link connected at one end to said arm and at its other end to a frame member fixed against movement in said transfer direction.

2. A forging machine transfer as set forth in claim 1, wherein the connections of said linkage are pivot connections.

3. A forging machine transfer as set forth in claim 2, wherein said pivot connections are above said work stations.

4. A forging machine transfer for transferring elongated workpieces between two work stations comprising a pair of grippers operable to close and grip a workpiece at one work station and to move in a transfer direction with a gripped workpiece to another work station, one of said grippers being pivoted to rotate said workpiece about an axis which is not parallel to the length of said gripped workpiece, and drive means connected to rotate said one gripper in response to movement in said transfer direction between said work stations, the other of said grippers being free of drive means to cause rotation thereof, said drive means being a linkage including an arm extending laterally with respect to said one gripper pivoted to a drag link through a universal joint, and said drag link being pivoted at its other end to a frame member fixed against movement in said transfer direction.

5. A hot forging machine transfer for transferring workpieces between two work stations, comprising a pair of vertically aligned grippers operable to close and grip a workpiece at one work station and to move the gripped workpiece to another work station, the upper of said grippers being pivoted to rotate said workpiece during such movement, and drive means connected to rotate said upper gripper in response to movement of said transfer between said work stations, the lower of said grippers providing a flat platform fixed against rotation with said upper gripper, said upper gripper causing a gripped workpiece to slide along said platform as said workpiece is turned thereby.

6. A forging machine transfer as set forth in claim 5, wherein the rotation of said one gripper is about a pivot axis which is eccentric with respect to said gripped workpiece.

7. A forging machine comprising a plurality of work stations spaced along a work face in which elongated workpieces are progressively formed, a transfer providing a gripper operable to grip a workpiece in a first position adjacent to one work station and to transfer it to a second position adjacent to a subsequent work station, a linkage connected to at least one of said grippers operating to rotate said one gripper and a workpiece gripped thereby through an angle less than 180 degrees in response to transfer movement, means for moving said gripper with a gripped workpiece toward said work face during transfer so that said workpiece is closer to said work face in said second position than it is in said first position.

8. A forging machine as set forth in claim 7, wherein said forging machine is a hot forging machine operable to work hot workpieces, and said linkage is located above said work stations.

9. A forging machine as set forth in claim 7, wherein said transfer includes additional grippers which operate to transfer workpieces betweeen work stations without turning.

10. A forging machine as set forth in claim 7, wherein said one gripper turns a workpiece through substantially 90 degrees during its transfer.

11. A forging machine comprising a plurality of work stations spaced along a work face in which elongated workpieces are progressively formed, a transfer providing a gripper operable to grip a workpiece in a first position adjacent to one work station and to transfer it to a second position adjacent to a subsequent work station, a linkage connected to at least one of said grippers operating to rotate said one gripper and a workpiece gripped thereby through an angle less than 180 degrees in response to transfer movement, said gripper moving a gripped workpiece toward said work face during transfer so that said workpiece is closer to said work face in said second position than it is in said first position, said linkage including a drag link secured against axial motion and located in a predetermined position when said one gripper is in both said first and second positions.

12. A forging machine as set forth in claim 11, wherein said transfer includes a frame member, and an elongated mounting member axially movable relative to said frame member, said one gripper being mounted on said mounting member, axial movement of said mounting member moving said one gripper between said first and second positions, said drag link being pivoted at said one end to said frame member.

13. A forging machine as set forth in claim 12, wherein said transfer includes additional grippers which operate to transfer workpieces between work stations without turning.

14. A forging machine as set forth in claim 13, wherein at least some of said grippers are provided with a floating mounting so that they can tip to a limited amount to grip workpieces of varying shapes.

15. A transfer for forging machines or the like comprising a pair of opposed grippers operable to grip an elongated workpiece having a first axis at a first work station to transfer said workpiece to the second work station, at least one of said grippers being rotatable about a pivot axis substantially perpendicular to a plane containing said first axis, and rotary drive means operable in response to movement of said grippers between said work stations to turn said one of said grippers through an angle of substantially 90 degrees whereby a workpiece ejected from said work station in one orientation is turned along said plane through substantially 90 degrees before being positioned adjacent to said second work station, said work stations being substantially adjacent to a work face, said grippers being mounted on a reciprocating frame which moves a distance substantially equal to the spacing between said work stations, said one pivot axis being offset from said first axis so that a workpiece is moved toward said work face as it is transferred between said work stations.

16. A transfer for transferring elongated workpieces between two work stations and partially turning such workpieces during such transfer, comprising a frame movable through a stroke length substantially equal to the spacing between a first work station and a second work station, gripper means mounted on said frame for pivotal movement about a first pivot axis which is not parallel to the length of said workpiece and movable with said frame between a workpiece-receiving position adjacent said first work station and a workpiece-releasing position adjacent said second work station, and a pivoted drive linkage connected to said gripper means operable in response to movement thereof between said work stations to rotate said gripper means through a predetermined angle substantially greater than zero and substantially less than 180 degrees, said linkage including an arm member on said gripper means, and a drag link pivotally connected to said arm for relative rotation about a second pivot axis, the distance between said first and second pivot axes being determined by the formula:

$$A = S/2 \text{ sine } (a/2)$$

where:

A = the spacing between said first and second axes,
S = the spacing between work stations, and
a = the predetermined angle.

17. The transfer as set forth in claim 16, wherein said gripper means grips a workpiece in a position eccentric from said first axis.

18. A forging machine transfer for transferring workpieces between two work stations, comprising a pair of grippers operable to close and grip a workpiece at one work station and to move in a transfer direction to another work station, a support for one of said grippers, and swivel means connecting said support and said one gripper, said swivel means operating to compensate for variations in size between said workpieces and causing said one gripper to properly position itself with respect to the other of said grippers to properly grip workpieces of varying size therebetween, said other gripper providing a substantially flat platform surface which is fixed against rotation with said one gripper and along which a workpiece slides as said one gripper rotates.

19. A forging machine transfer for transferring workpieces between two work stations, comprising a pair of grippers operable to close and grip a workpiece at one work station and to move in a transfer direction to another work station, a support for one of said grippers, and swivel means connecting said support and said one gripper, said swivel means operating to compensate for variations in size between said workpieces and causing said one gripper to properly position itself with respect to the other of said grippers to properly grip workpieces of varying size therebetween, said support turning about an axis during transfer, and said swivel connection providing a drive causing said one gripper to turn with said support about said axis as said support turns.

20. A forging machine as set forth in claim 19, wherein said other gripper provides a fixed flat gripping surface substantially perpendicular to said axis, and said one gripper causes said workpiece to turn with said one gripper and slide with respect to said gripping surface as said transfer moves to said another work station.

* * * * *